US006322434B1

(12) United States Patent
Satoh et al.

(10) Patent No.: US 6,322,434 B1
(45) Date of Patent: Nov. 27, 2001

(54) POLISHING APPARATUS INCLUDING ATTITUDE CONTROLLER FOR DRESSING APPARATUS

(75) Inventors: Ichiju Satoh; Norio Kimura, both of Kanagawa-ken (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/522,704

(22) Filed: Mar. 10, 2000

(30) Foreign Application Priority Data

Mar. 11, 1999 (JP) ..... 11-065710

(51) Int. Cl.[7] ..... B24B 21/18
(52) U.S. Cl. ..... 451/443; 451/56
(58) Field of Search ..... 451/56, 443, 41, 451/285, 287, 288

(56) References Cited

U.S. PATENT DOCUMENTS

| | | | | |
|---|---|---|---|---|
| 5,486,131 | * | 1/1996 | Cesna et al. | 451/56 |
| 5,503,590 | * | 4/1996 | Saitoh et al. | 451/41 |
| 5,643,067 | * | 7/1997 | Katsuoka et al. | 451/56 |
| 5,885,147 | * | 3/1999 | Kreager et al. | 451/56 |
| 5,904,615 | * | 5/1999 | Jeong et al. | 451/56 |
| 5,951,368 | | 9/1999 | Watanabe et al. . | |

FOREIGN PATENT DOCUMENTS

| | | |
|---|---|---|
| 0 589 433 | 3/1994 | (EP) . |
| 2 287 422 | 9/1995 | (GB) . |
| 10-58308 | 3/1998 | (JP) . |
| 99/50024 | 10/1999 | (WO) . |

OTHER PUBLICATIONS

Patent Abstracts of Japan, No. 11198026, published Jul. 27, 1999; Patent Abstracts of Japan, No. 07112362, published May 2, 1995.

* cited by examiner

*Primary Examiner*—Eileen P. Morgan
(74) *Attorney, Agent, or Firm*—Wenderoth, Lind & Ponack, L.L.P.

(57) ABSTRACT

A dressing apparatus dresses the polishing surface of a turntable while controlling the orientation of a dresser body with electromagnetic forces, thereby allowing an increase in the degree of flatness of the polishing surface of the turntable. A polishing apparatus having the dressing apparatus is also provided. The dressing apparatus includes a dresser body which dresses the polishing surface by contacting it. A pressing device presses the dresser body against the polishing surface of the turntable. An orientation controller controls the orientation of the dresser body by utilizing electromagnetic forces.

16 Claims, 9 Drawing Sheets

POLISHING APPARATUS INCLUDING ATTITUDE CONTROLLER FOR DRESSING APPARATUS

BACKGROUND OF THE INVENTION

The present invention relates to a polishing apparatus for polishing a semiconductor wafer surface, particularly a semiconductor wafer with a device pattern formed thereon by engaging the semiconductor wafer surface with a polishing cloth to effect planarization of the wafer surface. More particularly, the present invention relates to a dressing apparatus for dressing a polishing cloth bonded to a turntable of such a polishing apparatus.

With recent rapid progress in technology for fabricating high-integration semiconductor devices, circuit wiring patterns have been becoming increasingly fine, with spaces between wiring patterns also decreasing. As wiring spacing decreases to less than 0.5 microns, the depth of focus in circuit pattern formation in photolithography and the like becomes shallower. Accordingly, surfaces of semiconductor wafers on which circuit pattern images are to be formed by a stepper are required to be polished by a polishing apparatus to have an exceptionally high degree of surface flatness or planarization. As one method for such a planarization, for example, a chemical/mechanical polishing (CMP) method has been used, in which mechanical polishing is carried out while a polishing solution having a predetermined chemical composition is supplied.

In a conventional polishing apparatus for polishing a semiconductor wafer surface, in particular, a semiconductor wafer with a device pattern formed thereon to effect planarization thereof, a nonwoven fabric is used as a polishing cloth bonded to the upper surface of a turntable.

However, the degree of integration of ICs and LSIs has been increasing in recent years. Consequently, it is demanded that a polished surface be planarized to an even higher degree. To meet such a demand, a relatively rigid polishing cloth, for example, a polishing cloth made of urethane foam has come into use.

Polishing is carried out by rotating a turntable which has a polishing cloth affixed thereto, with the polishing cloth being kept in contact with a semiconductor wafer during rotation of the turntable. During the polishing operation, however, abrasive particles (grains) and substances removed from the wafer surface during polishing tend to adhere to the polishing cloth, resulting in a deterioration of the quality of the polishing cloth, and a concomitant deleterious effect on the polishing operation. Consequently, when polishing of semiconductor wafers is repeatedly carried out using the same polishing cloth, the quality of polishing is adversely affected, and there is a danger that a wafer surface will not be evenly polished. To avoid this problem, conditioning known as "dressing" is carried out to normalize the surface of the polishing cloth before, after or during polishing of a semiconductor wafer.

When dressing a rigid polishing cloth made of a urethane foam or the like, a dresser tool comprising a material of high hardness such as diamond is generally employed. The polishing cloth is thus subject to grinding each time it is dressed. A polishing cloth made of urethane foam, for example, IC1000 (manufactured by Rodel Nitta Company) is designed to have tolerances of 1 micrometer or less each time it is dressed.

It is imperative that a polishing cloth have a flat polishing surface, in order for it to be able to polish an object uniformly to a high degree of planarity. Variations in orientation or attitude of a dresser tool resulting in non-uniformity of pressure during dressing result in a polishing cloth which does not have the requisite degree of flatness, and which is thus unable to polish a wafer to a required degree of planarity.

In the dresser tool described above, a decrease in the amount of pressure applied to a polishing cloth during dressing results in a decrease in the amount of grinding to which the polishing cloth is subject. This translates into an increase in the working life of the polishing cloth. However, such a decrease in the amount of pressure applied by a dresser to a polishing cloth during dressing has a negative influence on the stability of the dresser, whereby dressing may produce an uneven or undulating surface on a polishing cloth.

SUMMARY OF THE INVENTION

In view of the above-described circumstances, an object of the present invention is to provide an apparatus for dressing a polishing surface of a turntable wherein control of the attitude (i.e., tilt angle with respect to the polishing surface) or orientation of a dresser tool thereof is effected by utilizing electromagnetic forces. As a result, the polishing surface of a turntable can be polished to a requisite high degree of flatness.

Another object of the present invention is to provide polishing apparatus provided with such a dressing apparatus.

To attain the above-described objects, the present invention provides a dressing apparatus for dressing a polishing surface of a turntable that comes into sliding contact with an object to be polished. The dressing apparatus includes a dresser body which comes into contact with the polishing surface to effect dressing. A pressing device presses the dresser body against the polishing surface of the turntable. An attitude controller controls the attitude or orientation of the dresser body by utilizing an electromagnetic force.

In addition, the present invention provides a polishing apparatus which includes a turntable having a polishing surface that comes into sliding contact with an object to be polished, and a dressing apparatus for dressing the polishing surface. The dressing apparatus includes a dresser body for dressing the polishing surface by coming into contact with the polishing surface. A pressing device presses the dresser body against the polishing surface of the turntable. An attitude controller controls the attitude or orientation of the dresser body by utilizing an electromagnetic force.

According to the present invention, the attitude or orientation of a dresser is controlled by utilizing an electromagnetic force, thereby allowing dressing to be carried out while maintaining an optimum distribution of surface pressure on the polishing surface applied by the dresser. Accordingly, it is possible to obtain a polishing surface having a high degree of flatness.

The above and other objects, features and advantages of the present invention will become more apparent from the following description of the preferred embodiments thereof, taken in conjunction with the accompanying drawings.

BRIEF DESCRIPTION OF THE DRAWINGS

FIGS. 7(*a*)–(*c*) show details of the structure of a dresser body, in which: FIG. 7(*a*) is a bottom view;

FIG. 7(*b*) is a sectional view taken along the line a—a in FIG. 7(*a*); and FIG. 7(*c*) is an enlarged view of a portion b shown in FIG. 7(*b*).

DETAILED DESCRIPTION OF THE INVENTION

Embodiments of the dressing apparatus and polishing apparatus according to the present invention will be described below in detail with reference to FIGS. 1 to 11.

Figure 1:
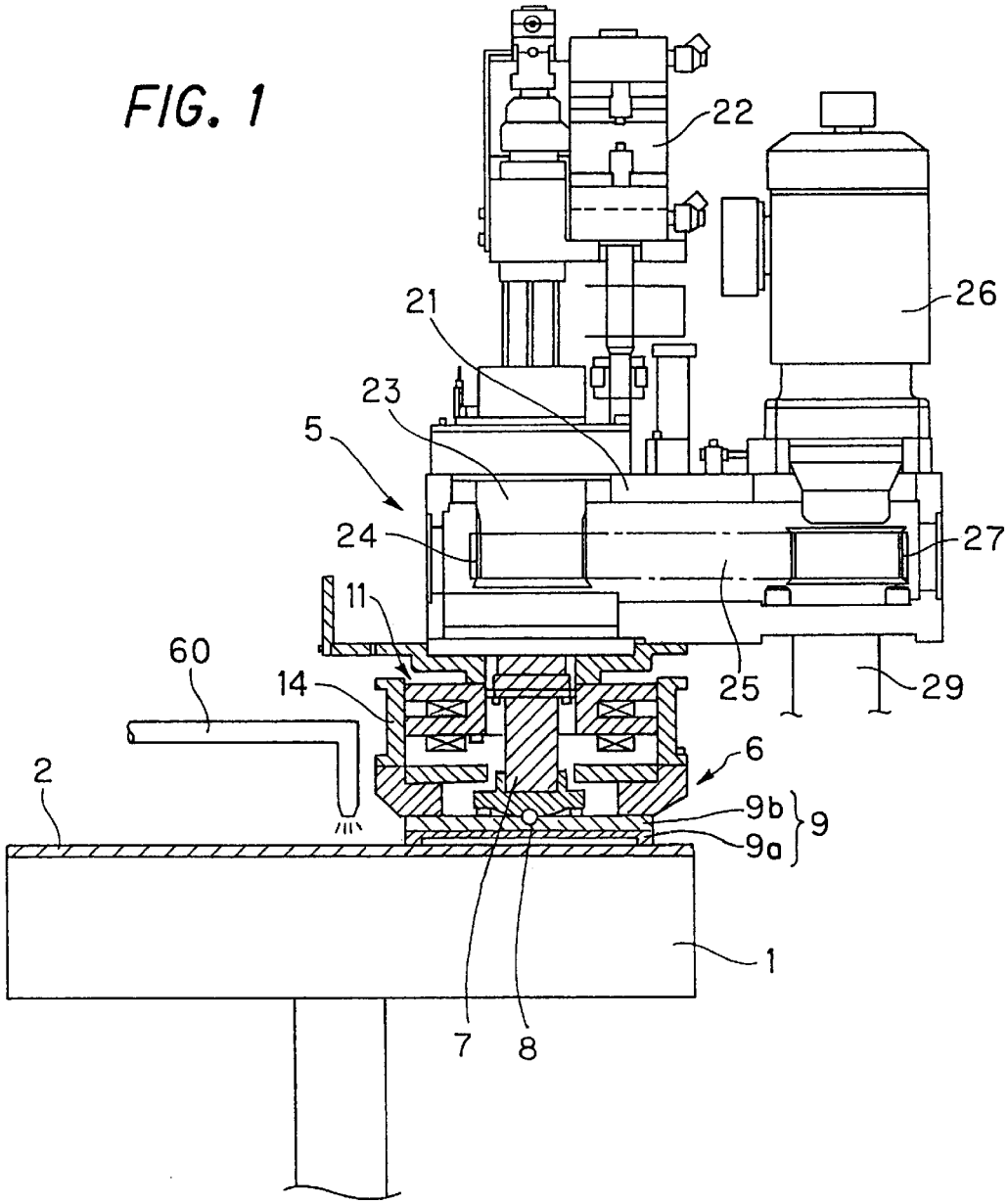
FIG. 1 is a vertical sectional view showing the general arrangement of a first embodiment of the polishing apparatus according to the present invention.
Figure 2:
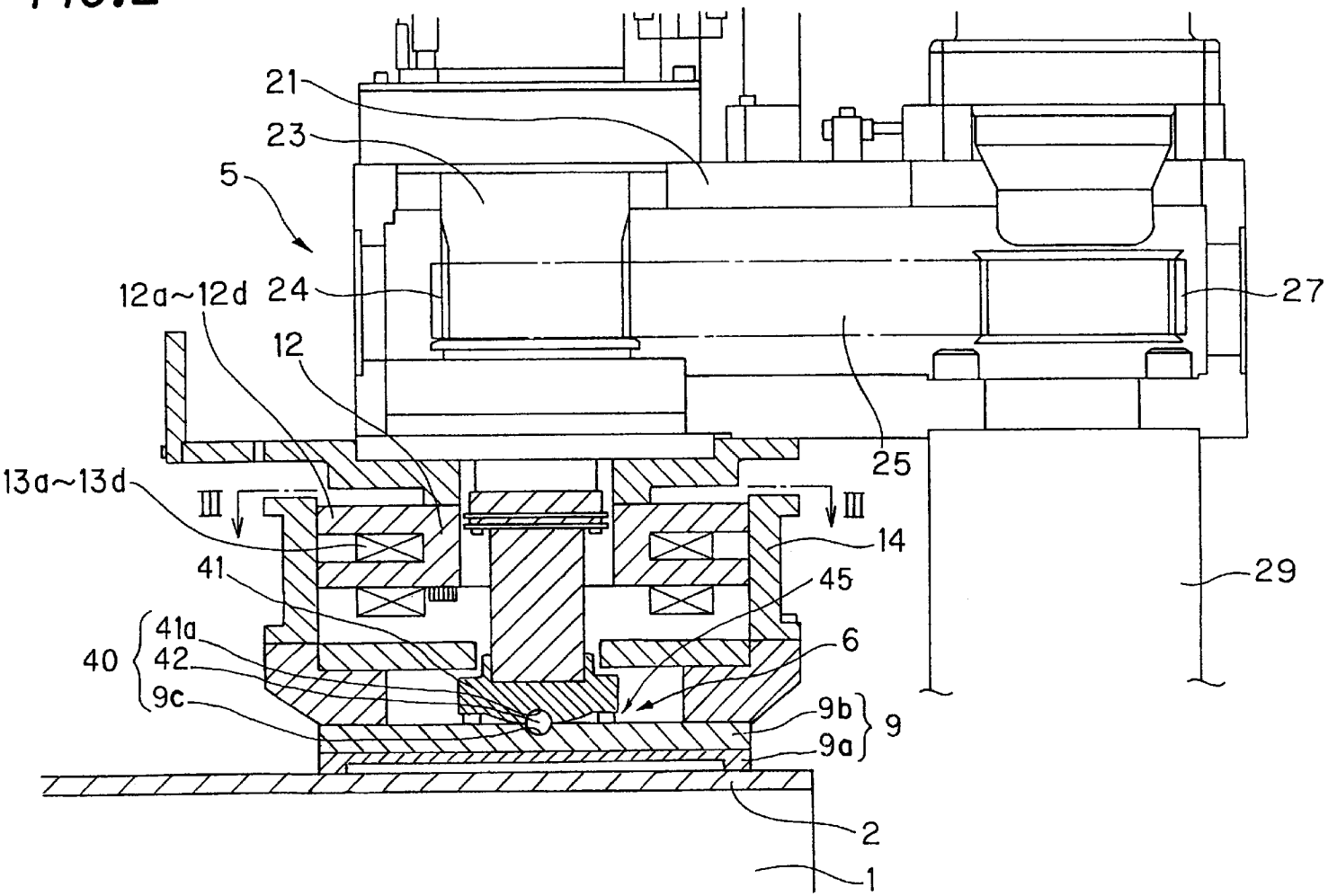
FIG. 2 is a fragmentary sectional view showing an essential part of the dressing apparatus according to the present invention.

FIG. 1 is a vertical sectional view showing the general arrangement of a first embodiment of the polishing apparatus according to the present invention, and FIG. 2 is a fragmentary sectional view showing an essential part of the dressing apparatus according to the present invention.

As shown in FIGS. 1 and 2, the polishing apparatus includes a turntable 1 having a polishing cloth 2 bonded to the upper surface thereof, and a dressing apparatus 5 for dressing the polishing cloth 2. The dressing apparatus 5 includes a dresser 6 for dressing the polishing cloth 2, and a dresser driving shaft 7 for supporting the dresser 6 and applying a pressing force and rotational driving force to the dresser 6. The dressing apparatus 5 further includes a universal coupling 8 for transmitting pressing force from the dresser driving shaft 7 to the dresser 6 while allowing these members to tilt relative to each other, and an attitude controller 11 for controlling the attitude or orientation of the dresser 6. A dressing liquid supply nozzle 60 is provided above the turntable 1 to supply a dressing liquid onto the polishing cloth 2 on the turntable 1. The upper surface of the polishing cloth 2 constitutes a polishing surface that comes into sliding contact with a surface of a semiconductor wafer to be polished.

As shown in FIG. 2, the dresser 6 includes a dresser body 9 comprising a dressing plate 9*a*, which constitutes a lower part of the dresser body 9, and a mounting plate 9*b*, which constitutes an upper part of the dresser body 9 connected to the dresser drive shaft 7. The dresser 6 further includes a diamond ring 10 electrodeposited on a projecting portion of the bottom surface of the dresser body 9 (see FIGS. 7A–7C).

As shown in FIG. 1, the dresser driving shaft 7 is coupled to a dresser air cylinder 22 secured to a dresser head 21. The dresser air cylinder 22 causes the dresser driving shaft 7 to move vertically, causing the diamond electrodeposited ring 10 on the lower end surface of the dresser 6 to be pressed against the turntable 1.

The dresser driving shaft 7 is coupled to a rotating cylinder 23 through a key (not shown). The rotating cylinder 23 has a timing pulley 24 on an outer peripheral portion thereof. The timing pulley 24 is connected through a timing belt 25 to a timing pulley 27 provided on a dresser motor 26 secured to the dresser head 21. Accordingly, the dresser motor 26 drivingly rotates the rotating cylinder 23 and the dresser driving shaft 7 through the timing pulley 27, the timing belt 25 and the timing pulley 24, thereby drivingly rotating the dresser 6. The dresser head 21 is supported by a dresser head shaft 29 fixedly supported on a frame.

The universal coupling 8, which transmits a pressing force from the dresser driving shaft 7 to the dresser 6 while allowing these members to tilt relative to each other, has a spherical bearing mechanism 40 that allows the dresser 6 and the dresser driving shaft 7 to tilt relative to each other. The universal coupling 8 further has a rotation transmitting mechanism 45 for transmitting the rotation of the dresser driving shaft 7 to the dresser body 9. The spherical bearing mechanism 40 includes a spherical recess 41*a* formed in the center of the lower surface of a driving flange 41 secured to the lower end of the dresser driving shaft 7. The spherical bearing mechanism 40 further includes a spherical recess 9*c* formed in the center of the upper surface of the mounting plate 9*b*, and a ball bearing 42 interposed between the two recesses 41*a* and 9*c*. The ball bearing 42 is made of a material of high hardness, such as a ceramic.

The rotation transmitting mechanism 45 includes a driving pin (not shown) secured to the driving flange 41 and a driven pin (not shown) secured to the mounting plate 9*b*. The driven pin and the driving pin are vertically movable relative to each other. Therefore, even when the dresser body 9 tilts, the driven pin and the driving pin are kept in engagement with each other, with a point of contact shifting between them. Thus, the rotation transmitting mechanism 45 transmits the rotational torque of the dresser driving shaft 7 to the dresser body 9 in a reliable and stable fashion.

Figure 3:
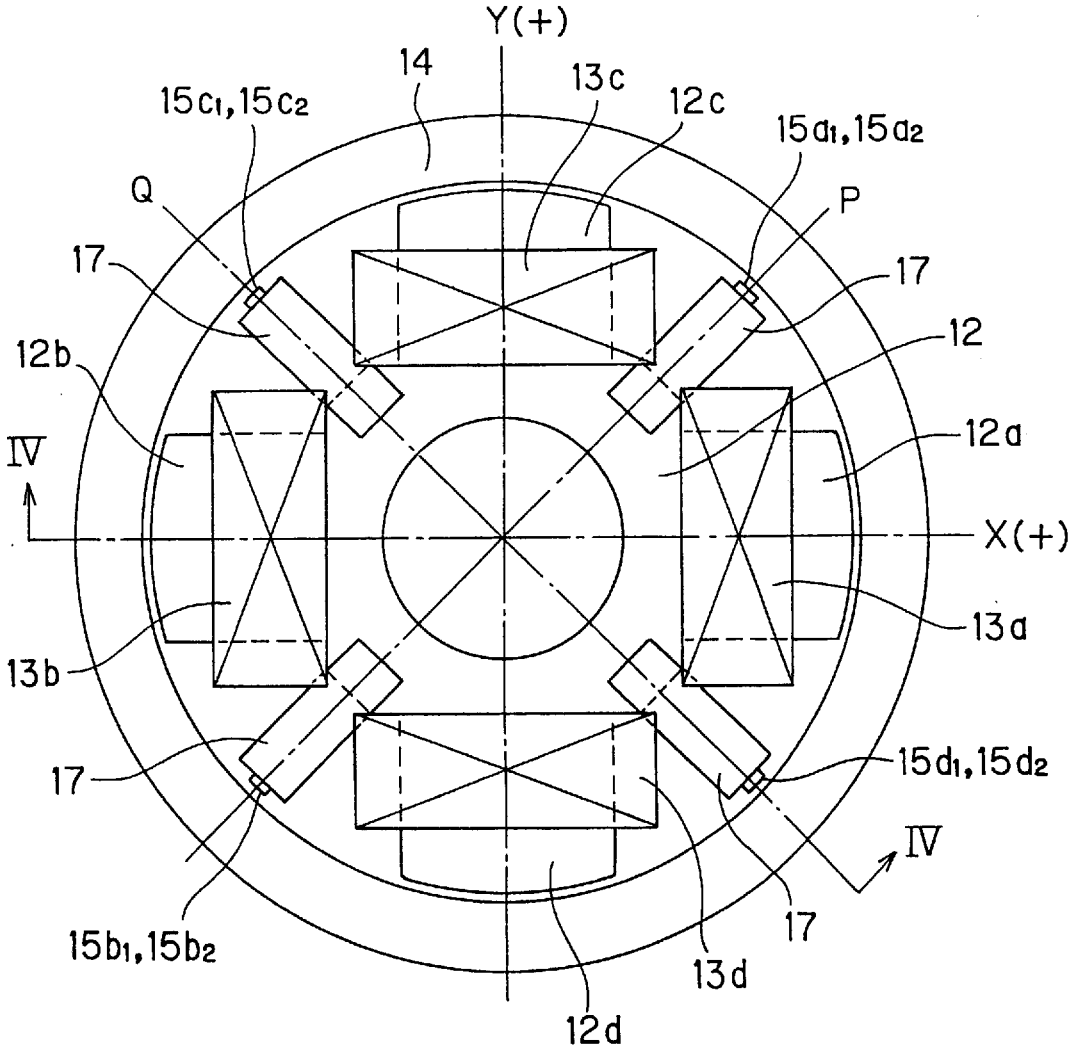
FIG. 3 is a sectional view taken along the line III—III in FIG. 2.

Next, the attitude controller 11 for controlling the attitude of the dresser 6 will be described with reference to FIGS. 2 to 6. FIG. 2 is a fragmentary sectional view showing an essential part of the dressing apparatus, as stated above. FIG. 3 is a view as seen in the direction of the arrow III—III in FIG. 2. and FIG. 4 is a sectional view taken along the line IV—IV in FIG. 3.

As shown in FIGS. 2 and 3, the attitude controller 11 includes an electromagnetic core 12 secured to the dresser head 21. Four magnetic poles 12*a*, 12*b*, 12*c* and 12*d* project radially outward from the electromagnetic core 12. Four electromagnetic coils 13*a*, 13*b*, 13*c* and 13*d* are wound on the magnetic poles 12*a* to 12*d*, respectively. The attitude controller 11 further includes a cylindrical armature 14 facing the magnetic poles 12*a* to 12*d* across a gap. The armature 14 is secured to the dresser body 9.

Figure 4:
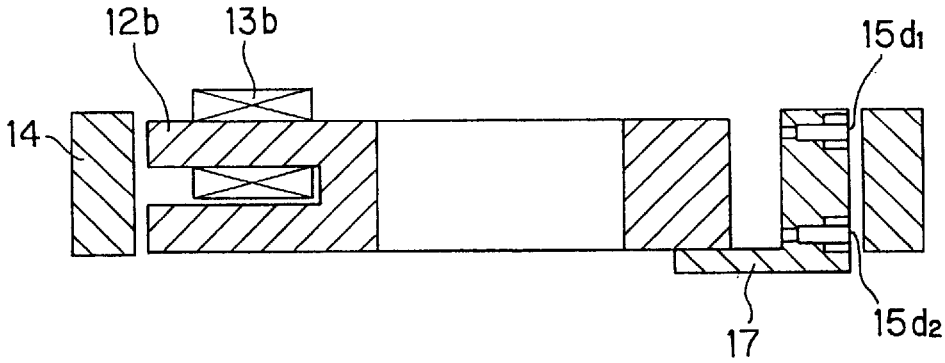
FIG. 4 is a sectional view taken along the line IV—IV in FIG. 3.

As shown in FIG. 4, the magnetic poles 12*a* to 12*d* each have a U-shaped sectional configuration having a 90-degree rotation. The upper horizontally projecting portions of the magnetic poles 12*a* to 12*d* are wound with the electromagnetic coils 13*a* to 13*d*, respectively. The magnetic poles 12*a* to 12*d* and the armature 14 are formed from a magnetic material, e.g. a permalloy. As shown in FIG. 3, the electromagnetic coil 13*a* is placed at a position in positive alignment with the X-axis. The electromagnetic coil 13*b* is placed at a position in negative alignment with the X-axis. The electromagnetic coil 13*c* is placed at a position in positive alignment with the Y-axis. The electromagnetic coil 13*d* is placed at a position in negative alignment with the Y-axis. Four pairs of displacement sensors 15$a_1$, 15$a_2$; 15$b_1$,15$b_2$; 15$c_1$, 15$c_2$; and 15$d_1$, 15$d_2$ are placed on two axes P and Q at an angle of 45 degrees with respect to the X- and Y-axes. Each pair of displacement sensors consists of upper and lower displacement sensors. Each displacement sensor pair is held by a sensor holder 17.

Figure 5:
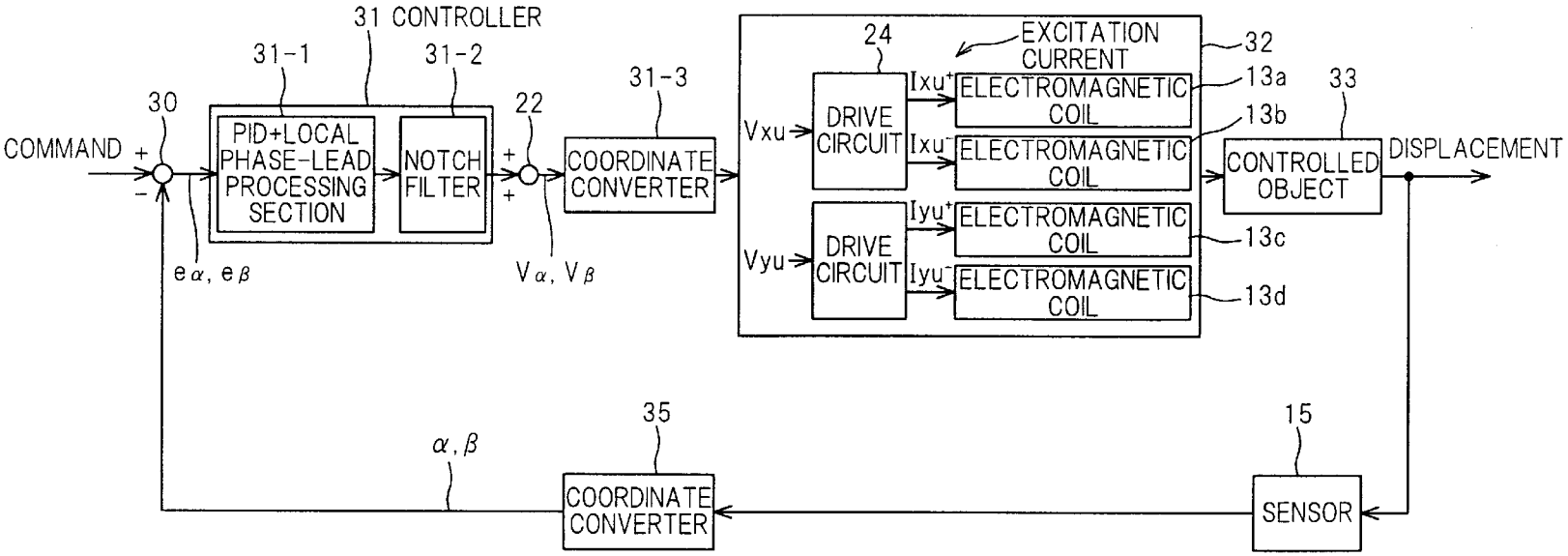
FIG. 5 is a block diagram showing the functional arrangement of a control part for controlling an attitude controller for a dresser.
Figure 6:
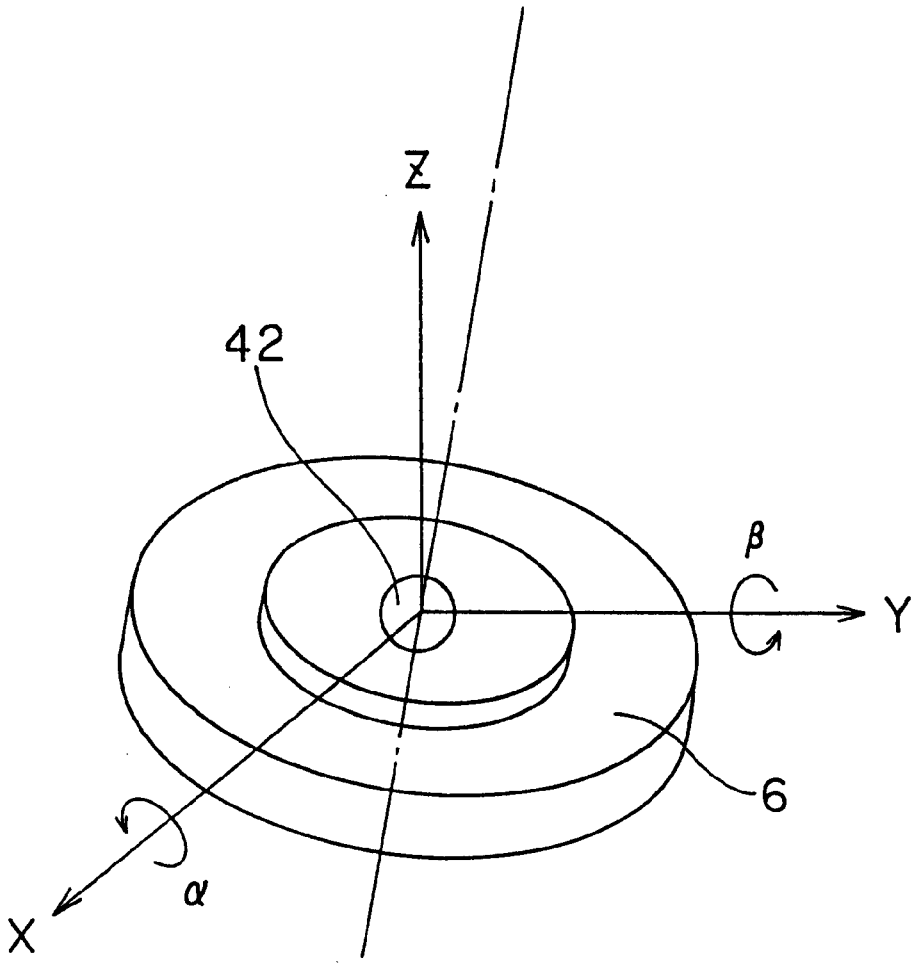
FIG. 6 is a diagram illustrating the relationship between the tilt α of the dresser with respect to an X-axis and the tilt β of the dresser with respect to a Y-axis.
Figure 7A:
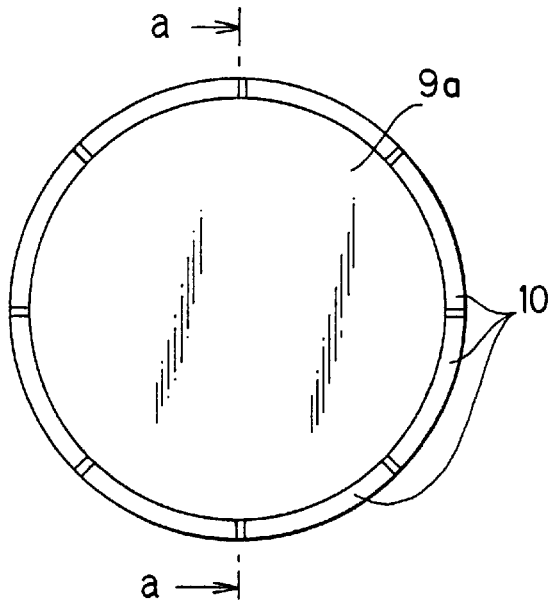
Figure 7B:
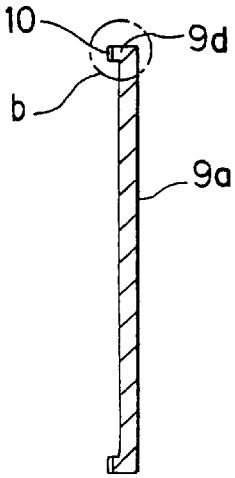
Figure 7C:
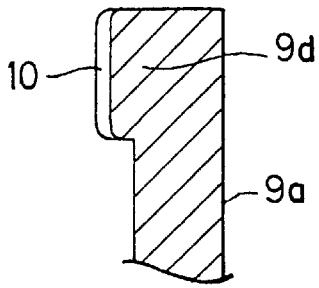

FIG. 5 is a block diagram showing the functional arrangement of a control part for controlling the attitude controller 11. As shown in the figure, the control part has a subtracter 30 and a controller 31. The subtracter 30 is supplied with desired values for the attitude of the dresser 6. and values α and β of displacement of a controlled object (dresser 6) that are detected by sensors 15 (displacement sensors 15$a_1$, 15$a_2$; 15$b_1$, 15$b_2$; 15$c_1$, 15$c_2$; and 15$d_1$, 15$d_2$) and converted in a coordinate converter 35. Differences between the desired values and the displacement values α and β derived from the subtracter 30 are input to the controller 31 as error signals eα and eβ. As shown in FIG. 6, α and β indicate a tilt with respect to an X-axis and a tilt with respect to a Y-axis, respectively. The X-axis and the Y-axis lie along a horizontal plane. In this case, the dresser 6 performs a combined motion consisting of tilting with respect to the X-axis and tilting with respect to the Y-axis about the bearing ball 42 acting as the center of rotation.

The error signals eα and eβ are subjected to a tilt control and attenuation processing in a PID+local phase-lead processing section 31-1 and are further passed through a notch filter 31-2 to remove vibrational components, and converted into voltage command signals Vα and Vβ. Then, in a coordinate converter 31-3, the voltage command signals Vα and Vβ are converted into control signals $V_{xu}$ and $V_{yu}$ output by the attitude controller for supply to a driver section 32.

The driver section 32 includes the electromagnetic coils 13*a,* 13*b,* 13*c* and 13*d* and drive circuits 24 for exciting these coils. The control signals $V_{xu}$ and $V_{yu}$ are supplied to the respective drive circuits 24, in which they are converted into excitation currents $I_{xu}$+, $I_{xu}$−, $I_{yu}$+ and $I_{yu}$− for displacing the armature 14 in any of the positive and negative directions of the X- and Y-axes shown in FIG. 3. The excitation currents $I_{xu}$+, $I_{xu}$−, $I_{yu}$+ and $I_{yu}$− are supplied to the electromagnetic coils 13*a,* 13*b,* 13*c* and 13*d* to control the attitude of the controlled object (dresser 6). In this case, the center of rotation (bearing ball 42) of the dresser 6 and the X- and Y-axes of the armature 14 shown in FIG. 3 are set apart from each other by a predetermined height (L). Therefore, when the armature 14 is displaced in the positive or negative direction of the X- or Y-axis shown in FIG. 3, the dresser body 9, that is, the dresser 6. can be tilted in the desired direction with respect to the horizontal plane about the bearing ball 42 as the center of rotation.

FIG. 7(*a*)–(*c*) show details of the structure of the dressing plate 9*a,* in which: FIG. 7(*a*) is a bottom view; FIG. 7(*b*) is a sectional view taken along the line a—a in FIG. 7(*a*); and FIG. 7(*c*) is an enlarged view of a portion b shown in FIG. 7(*b*). The dressing plate 9*a* has a disk-shaped configuration. An annular belt-shaped projecting portion 9*d* with a predetermined width is formed at the peripheral edge of the lower surface thereof to allow fine particles of diamond to be electrodeposited thereon. Thus, a diamond electrodeposited ring 10 is provided on the surface of the projecting portion 9*d* by electrodeposition of fine particles of diamond.

As is well known, in a polishing operation, a semiconductor wafer carried by a wafer carrier is pressed against the polishing cloth 2, while an abrasive liquid is supplied onto the polishing cloth. When the polishing operation is continued for a predetermined period of time, abrasive particles (grains) and substances removed from a wafer adhere to the polishing cloth 2 causing a deterioration in the surface of the polishing cloth 2. Therefore, a dressing operation for recovering the surface condition or polishing surface of the polishing cloth 2 is carried out by using the dressing apparatus 5 before, after or during polishing of a semiconductor wafer. More specifically, the turntable 1 and the dresser 6 are rotated, and a dressing liquid such as pure water is supplied from the dressing liquid supply nozzle 60 toward approximately the center of rotation of the polishing cloth 2. In this state, the surface of the diamond electrodeposited ring 10 is brought into contact with the polishing cloth surface to thereby shave the polishing cloth surface and effect dressing. The diamond electrodeposited ring 10 has a structure in which fine particles of diamond are deposited on the surface of the projecting portion 9*d,* and the diamond deposited portion is plated with nickel, thereby fixing the fine particles of diamond with the deposited nickel layer.

In this embodiment, the dimensions of the dresser 6 are, for example, as follows. The diameter of the dresser body 9 is 250 millimeters, and the diamond electrodeposited ring 10 having a width of 6 millimeters is formed on the peripheral edge of the lower surface of the dresser body 9. The diamond electrodeposited ring 10 is split into a plurality of portions (8 portions in the illustrated example). The diameter of the dresser body 9 is set to be larger than the diameter of a semiconductor wafer as an object to be polished so that when a semiconductor wafer is polished, the dressed surface of the polishing cloth includes sufficient margins for the surface of the semiconductor wafer to be polished in both radially inward and outward directions of the turntable 1. It should be noted that the diamond dresser having a diamond electrodeposited ring may be replaced with an SiC dresser using a ring having a plurality of SiC sectors. In this case, the SiC dresser has a structure similar to that shown in FIGS. 7(*a*)–(*c*). The SiC dresser has a large number of pyramidal projections of several tens of micrometers in size on the surface thereof.

During the above-described dressing process, the attitude of the dresser body 9 is controlled by the attitude controller 11. In this case, as has been stated above, the tilt of the dresser body 9 is detected by processing the outputs of the displacement sensors 15 (15$a_1$, 15$a_2$; 15$b_1$, 15$b_2$; 15$c_1$, 15$c_2$; and 15$d_1$, 15$d_2$), and the tilt of the dresser body 9 is rectified to cause the dresser body 9 to lie in a horizontal plane. Alternatively, the dresser body 9 is controlled to a desired angle in a desired direction with respect to the horizontal plane. As such, a strictly parallel relation between the dressing surface of the dresser body 9, that is, the lower surface of the diamond electrodeposited ring 10, and the upper surface of the polishing cloth 2, that is, the polishing surface can be maintained during the dressing operation.

According to this embodiment, a force for pressing the dresser body 9 against the polishing surface of the turntable 1 is obtained by transmitting the pressing force of the air cylinder 22 directly to the dresser 6. To control the attitude of the dresser 6, the state of the polishing surface on the upper side of the turntable 1, including undulations or the like, are previously measured and input to the controller so that an optimum attitude of the dresser 6 is obtained on the basis of the data input in advance. Thus, optimum attitude of the carrier 6 is effected by the attitude controller 11 on the basis of the detection of the attitude by means of the displacement sensors 15.

Figure 8:
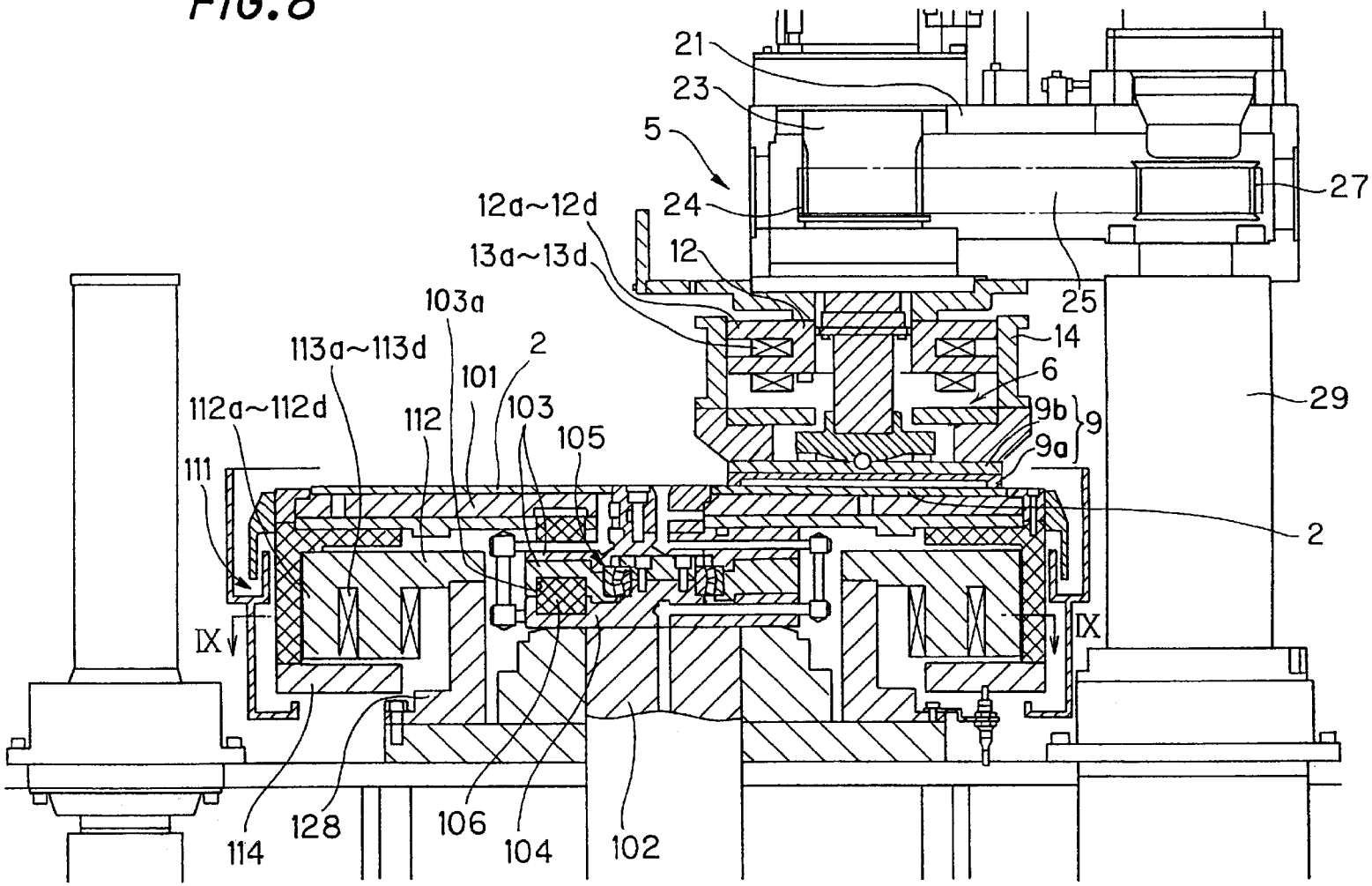
FIG. 8 is a vertical sectional view showing the general arrangement of a second embodiment of the polishing apparatus according to the present invention.
Figure 9:
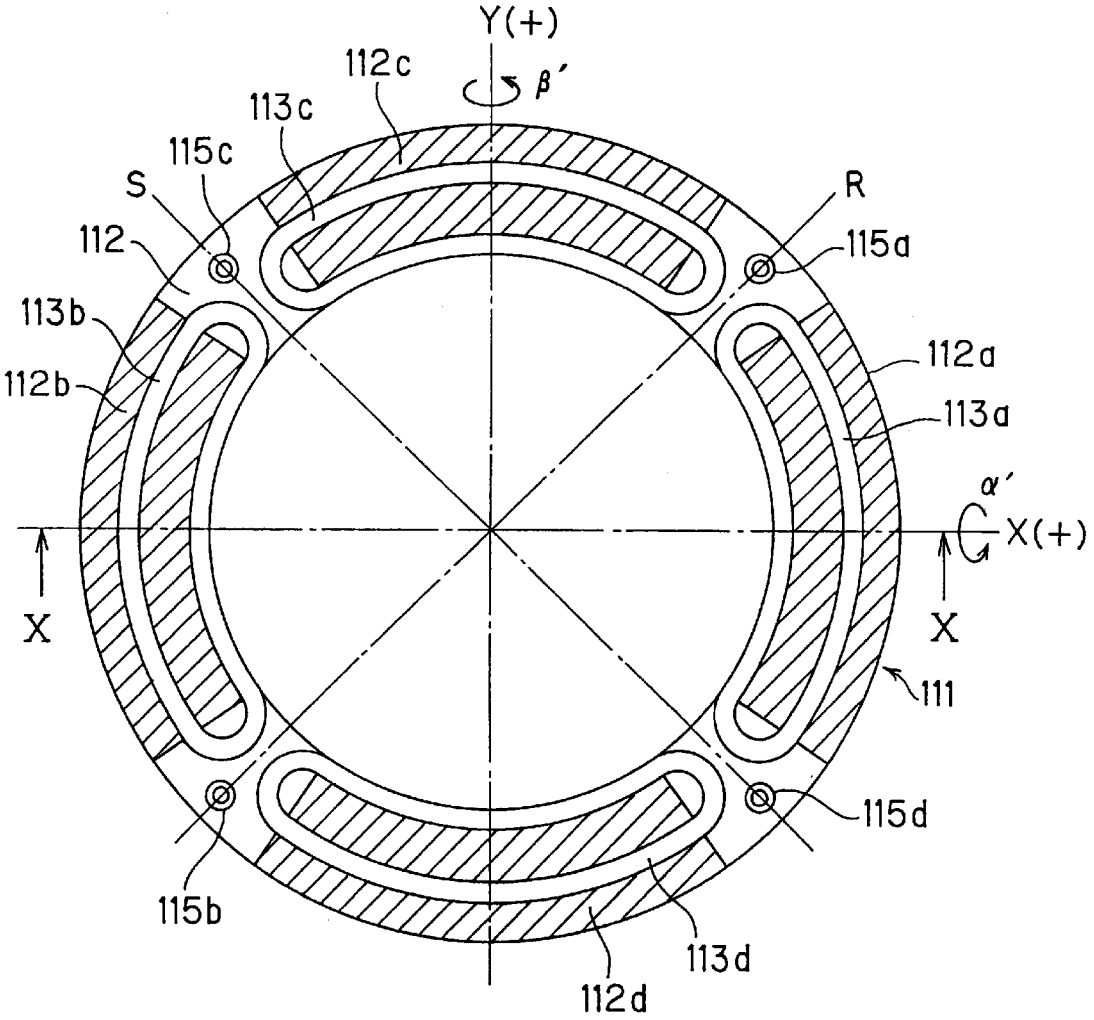
FIG. 9 is a sectional view taken along the line IX—IX in FIG. 8.
Figure 10:
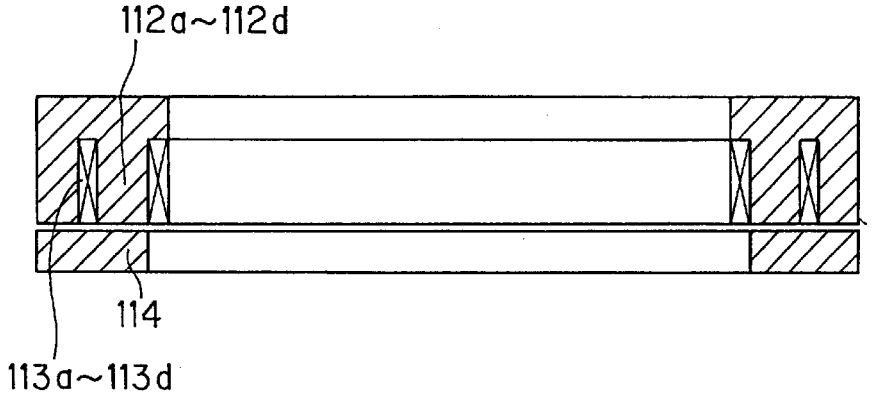
FIG. 10 is a sectional view taken along the line X—X in FIG. 9.

With reference to FIGS. 8 to 11, there is shown a polishing apparatus provided with a dressing apparatus in accordance with a second embodiment of this invention. FIG. 8 is a vertical sectional view of the polishing apparatus. FIG. 9 is a sectional view taken along the line IX—IX in FIG. 8. FIG. 10 is a sectional view taken along the line X—X in FIG. 9.

In the second embodiment, the arrangement of a dresser unit including a dresser 6 and an attitude controller 11 is the same as in the first embodiment. The second embodiment differs from the first embodiment in the arrangement of a turntable. That is, in the second embodiment, the turntable is provided with an attitude controller.

As shown in FIG. 8, a turntable 101 having a polishing cloth 2 on the upper surface thereof and a rotating shaft 102 of a motor (not shown) are coupled to each other through upper and lower coupling members 103 and 104. The lower coupling member 104 is secured to the upper end of the rotating shaft 102 of the motor. The upper coupling member 103 is secured to the lower surface of the turntable 101. A self-aligning roller bearing 105 is disposed between the lower coupling member 104 and the upper coupling member 103 to allow the turntable 101 and the upper coupling member 103 to tilt in any direction with respect to the lower coupling member 104 about the self-aligning roller bearing 105 which acts as the center of rotation. The lower coupling member 104 is provided with a short column-shaped pin 106 that is engaged with an engagement hole 103*a* provided in the upper coupling member 103 to allow the turntable 101 to rotate. It should be noted that a predetermined clearance is formed between the engagement hole 103*a* and the pin 106 to enable tilting of the turntable 101.

In this embodiment, an attitude controller 111 for controlling the attitude of the turntable 101 is provided. The attitude controller 111 includes an electromagnetic core 112 secured to a frame 28. The electromagnetic core 112 is provided with four magnetic poles 112*a*, 112*b*, 112*c* and 112*d*. Four electromagnetic coils 113*a*, 113*b*, 113*c* and 113*d* are wound on the magnetic poles 112*a* to 112*d*, respectively. The attitude controller 111 further includes an annular disk-shaped armature 114 facing the magnetic poles 112*a* to 112*d* across a gap. The armature 114 is secured to the turntable 101.

As shown in FIG. 10, the magnetic poles 112*a* to 112*d* each have an inverted U-shaped sectional configuration. The inner portions of the inverted U-shaped magnetic poles 112*a* to 112*d* are wound with the electromagnetic coils 113*a* to 113*d*, respectively. The magnetic poles 112*a* to 112*d* and the armature 114 are formed from a magnetic material, e.g. a permalloy. As shown in FIG. 9, the electromagnetic coil 113*a* is placed at a position in positive alignment with the X-axis. The electromagnetic coil 113*b* is placed at a position in negative alignment with the X-axis. The electromagnetic coil 113*c* is placed at a position in positive alignment with the Y-axis. The electromagnetic coil 113*d* is placed at a position in negative alignment with the Y-axis. Four displacement sensors 115*a*, 115*b*, 115*c* and 115*d* are placed on two axes R and S tilted at 45 degrees with respect to the X- and Y-axes.

Figure 11:
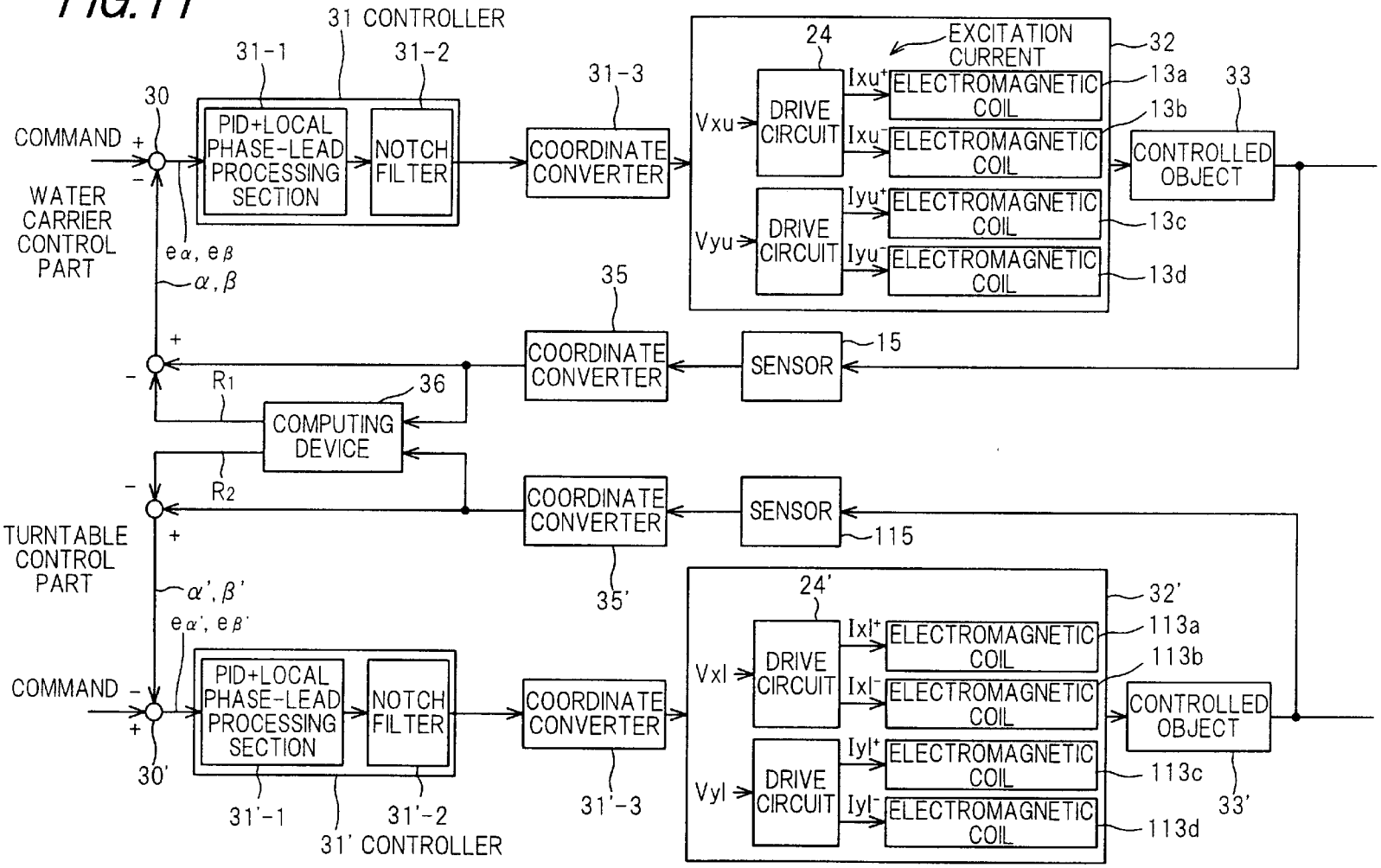
FIG. 11 is a block diagram showing the functional arrangement of a control part for controlling an attitude controller for a turntable.

FIG. 11 is a block diagram showing the functional arrangement of a control part for controlling the attitude controller 111. As shown in the figure, the turntable control part and the dresser control part each have an arrangement similar to that of the control part shown in FIG. 5. The arrangement shown in FIG. 11 is additionally provided with a computing device for precisely detecting relative positions of the dresser and the turntable on the basis of signals input thereto from the dresser control part and the turntable control part.

As shown in FIG. 11, the dresser control part has a subtracter 30 and a controller 31. The subtracter 30 is supplied with desired values for the attitude of the dresser, and values $\alpha$ and $\beta$ of displacement of the controlled object that are detected by sensors 15 and converted in a coordinate converter 35 and further corrected by a computing device 36 on the basis of information concerning the tilt of the turntable. Differences between the desired values and the displacement values $\alpha$ and $\beta$ derived from the subtracter 30 are input to the controller 31 as error signals $e\alpha$ and $e\beta$.

The turntable control part has a subtracter 30' and a controller 31'. The subtracter 30' is supplied with desired values for the attitude of the turntable and values $\alpha'$ and $\beta'$ of displacement of the controlled object that are detected by sensors 115 (displacement sensors 15*a*, 115*b*, 115*c* and 115*d*) and converted in a coordinate converter 35', and further modified by the computing device 36 on the basis of information concerning the tilt of the dresser. Differences between the desired values and the displacement values $\alpha'$ and $\beta'$ derived from the subtracter 30' are input to the controller 31' as error signals $e\alpha'$ and $e\beta'$.

The computing device 36 computes relative errors from information concerning the tilt of the dresser and information concerning the tilt of the turntable to generate rectified displacement values $\alpha$, $\beta$, $\alpha'$ and $\beta'$, thereby allowing control to be effected with a high degree of accuracy. Normally, the degree of accuracy can be raised by correcting the desired position of the dresser with reference to the tilt of the turntable. Thus, the feedback R1 to the dresser may be omitted. Further, the computing device may be omitted. As shown in FIG. 9, $\alpha'$ and $\beta'$ indicate a tilt with respect to an X-axis and a tilt with respect to a Y-axis, respectively. In this case, the turntable 101 performs a combined motion consisting of tilting with respect to the X-axis and tilting with respect to the Y-axis about the self-aligning roller bearing 105 which acts as the center of rotation.

The error signals $e\alpha'$ and $e\beta'$ are subjected to tilt control and attenuation processing in a PID+local phase-lead processing section 31'-1 and further passed through a notch filter 31'-2 to remove vibrational components, to thereby be converted into voltage command signals $V\alpha'$ and $V\beta'$. Then, in a coordinate converter 31'-3, the voltage command signals $V\alpha'$ and $V\beta'$ are converted into control signals $V_{xl}$ and $V_{yl}$ for the attitude controller, which are supplied to a driver section 32'.

The driver section 32' includes the electromagnetic coils 113*a*, 113*b*, 113*c* and 113*d* and drive circuits 24' for exciting these coils. The control signals $V_{xl}$ and $V_{yl}$ are supplied to the respective drive circuits 24', in which they are converted into excitation currents $I_{xl}+$, $I_{xl}-$, $I_{yl}+$ and $I_{yl}-$ for displacing the armature 114 in any of the positive and negative directions of the X- and Y-axes shown in FIG. 8. The excitation currents $I_{xl}+$, $I_{xl}-$, $I_{yl}+$ and $I_{yl}-$ are supplied to the electromagnetic coils 113*a*, 113*b*, 113*c* and 113*d* to control the attitude of the controlled object (turntable 101) 33'.

According to the embodiment shown in FIGS. 8 to 11, it is possible to control the attitude of the turntable 101 in addition to the attitude of the dresser 6. Therefore, it is possible to carry out dressing while maintaining the dressing surface of the dresser body 9 and the polishing surface on the turntable 101 in an optimum state.

As has been stated above, according to the present invention, the attitude of the dresser is controlled by utilizing electromagnetic forces, thereby allowing dressing to be carried out while maintaining an optimum distribution of surface pressure applied to the polishing surface from the dresser. Accordingly, it is possible to obtain a polishing surface having a high degree of flatness.

Further, according to the present invention, a pressing force under which the dressing surface of the dresser body is pressed against the polishing surface of the turntable is obtained by transmitting the pressing force of the air cylinder directly to the dresser. Only the control of the tilt of the dresser is effected by the attitude controller by utilising electromagnetic forces. Therefore, the attitude controller is able to be compact in size and simple in structure.

It should be noted that the present invention is not necessarily limited to the foregoing embodiments but can be modified in a variety of ways without departing from the gist of the present invention.

What is claimed is:

1. A dressing apparatus for dressing a polishing surface that is to come into sliding contact with an object to be polished, said dressing apparatus comprising:

a dresser body for dressing the polishing surface by contacting the polishing surface;

a pressing mechanism for pressing said dresser body against the polishing surface of the turntable; and an attitude controller for controlling an attitude or orientation of said dresser body by using an electromagnetic force.

2. The dressing apparatus according to claim 1, wherein said dresser body has a dressing surface formed on a lower side thereof and adapted to be engaged with the polishing surface, said attitude controller being operable to control a tilt angle of said dressing surface with respect to the polishing surface in a running direction of the polishing surface.

3. A polishing apparatus comprising:

a turntable having a polishing surface that is to come into sliding contact with an object to be polished; and a dressing apparatus for dressing said polishing surface, said dressing apparatus comprising:

a dresser body for dressing said polishing surface by contacting said polishing surface;

a pressing mechanism for pressing said dresser body against said polishing surface of said turntable; and an attitude controller for controlling an attitude or orientation of said dresser body by using an electromagnetic force.

4. The polishing apparatus according to claim 3, wherein said dresser body has a dressing surface formed on a lower side thereof and adapted to be engaged with said polishing surface, said attitude controller being adapted to control a tilt angle of said dressing surface with respect to said polishing surface in a running direction of said polishing surface.

5. The polishing apparatus according to claim 3, wherein said pressing mechanism is a drive shaft for rotating said dresser body, said dressing apparatus further comprising a universal joint connecting said drive shaft and said dresser body in such a manner that said dresser body can tilt relative to said drive shaft.

6. The polishing apparatus according to claim 5, wherein said dressing apparatus further comprises a frame for supporting said drive shaft in such a manner that said drive shaft can rotate about a longitudinal axis of said drive shaft, said attitude controller comprising:

an electromagnetic device fixed on said frame for generating the electromagnetic force; and an armature fixed on said dresser body and adapted to be moved by using the electromagnetic force generated by said electromagnetic device.

7. The polishing apparatus in accordance with claim 6, wherein said attitude controller includes at least one sensor for sensing the attitude or orientation of said dresser body, said attitude controller being adapted to control the attitude of said dresser body in response to the attitude or orientation sensed by said at least one sensor.

8. The polishing apparatus according to claim 3, wherein said polishing apparatus further comprises:

a turntable drive shaft for rotating said turntable;

a joint for connecting said turntable drive shaft to said turntable in such a manner that said turntable can be rotated while being allowed to tilt relative to said turntable drive shaft; and a turntable attitude controller for controllably tilting said turntable about said joint by using an electromagnetic force.

9. The polishing apparatus according to claim 8, wherein said polishing apparatus further comprises a stationary frame, and said turntable attitude controller comprises:

an electromagnetic device fixed on said stationary frame of said polishing apparatus for generating an electromagnetic force; and an armature fixed on said turntable and adapted to be moved by using the electromagnetic force generated by said electromagnetic device.

10. The polishing apparatus according to claim 4, wherein said pressing mechanism is a drive shaft for rotating said dresser body, said dressing apparatus further comprising a universal joint connecting said drive shaft and said dresser body in such a manner that said dresser body can tilt relative to said drive shaft.

11. A polishing apparatus comprising:

a polishing surface that is to come into sliding contact with an object to be polished; and a dressing apparatus for dressing said polishing surface, said dressing apparatus comprising:

a dresser body for dressing said polishing surface by contacting said polishing surface;

a drive shaft for supporting said dresser body in such a manner that said dresser body can be tilted relative to said drive shaft; and an attitude controller for controlling an attitude or orientation of said dresser body by using an electromagnetic force.

12. The polishing apparatus according to claim 11, wherein said dresser body has a dressing surface formed on a lower side thereof and adapted to be engaged with said polishing surface, said attitude controller being adapted to control a tilt angle of said dressing surface with respect to said polishing surface in a running direction of said polishing surface.

13. The polishing apparatus according to claim 11, wherein said dressing apparatus further comprises a universal joint connecting said drive shaft and said dresser body in such a manner that said dresser body can tilt relative to said drive shaft.

14. The polishing apparatus according to claim 11, wherein said dressing apparatus further comprises a frame for supporting said drive shaft in such a manner that said drive shaft can rotate about a longitudinal axis of said drive shaft, said attitude controller comprising:

an electromagnetic device fixed on said frame for generating the electromagnetic force; and an armature fixed on said dresser body and adapted to be moved by using the electromagnetic force generated by said electromagnetic device.

15. The polishing apparatus in accordance with claim 14, wherein said attitude controller includes a plurality of sensors for sensing the attitude or orientation of said dresser body, said attitude controller being adapted to control the attitude of said dresser body in response to the attitude or orientation sensed by said sensors.

16. The polishing apparatus according to claim 11, wherein said polishing apparatus further comprises:

a turntable, said polishing surface being formed on said turntable;

a turntable drive shaft for rotating said turntable;

a joint for connecting said turntable drive shaft to said turntable in such a manner that said turntable can be rotated while being allowed to tilt relative to said turntable drive shaft; and a turntable attitude controller for controllably tilting said turntable about said joint by using an electromagnetic force.

* * * * *